US007243517B2

(12) United States Patent
Sieger

(10) Patent No.: US 7,243,517 B2
(45) Date of Patent: Jul. 17, 2007

(54) METHOD AND DEVICE FOR DEFORMING A WORKPIECE MADE OF A MATERIAL HAVING AN EXPONENTIAL TENSILE STRESS-STRAIN BEHAVIOR INTO A THIN-WALLED, HOLLOW SHELL

(75) Inventor: Erich Sieger, Friedrichshafen (DE)

(73) Assignee: Firma Erich Sieger, Friedrichshafen (DE)

( * ) Notice: Subject to any disclaimer, the term of this patent is extended or adjusted under 35 U.S.C. 154(b) by 95 days.

(21) Appl. No.: 10/553,031

(22) PCT Filed: Apr. 8, 2004

(86) PCT No.: PCT/EP2004/003807

§ 371 (c)(1),
(2), (4) Date: Oct. 7, 2005

(87) PCT Pub. No.: WO2004/089560

PCT Pub. Date: Oct. 21, 2004

(65) Prior Publication Data

US 2006/0191307 A1 Aug. 31, 2006

(30) Foreign Application Priority Data

Apr. 11, 2003 (DE) ..... 103 16 854

(51) Int. Cl.
*B21D 22/14* (2006.01)

(52) U.S. Cl. ..... 72/83; 72/69; 72/85

(58) Field of Classification Search ..... 72/7.1, 72/7.3, 13.5, 13.6, 82, 83, 84, 85, 86, 69, 72/342.74, 378
See application file for complete search history.

(56) References Cited

U.S. PATENT DOCUMENTS

| | | | | |
|---|---|---|---|---|
| 3,248,918 | A | 5/1966 | Brown | |
| 3,316,745 | A | 5/1967 | Berghahn et al. | |
| 3,342,051 | A | 9/1967 | Leszak | |
| 3,815,395 | A | 6/1974 | Sass | |
| 5,218,849 | A | 6/1993 | Sieger et al. | |
| 5,355,705 | A * | 10/1994 | Schulze et al. | 72/83 |
| 5,426,964 | A | 6/1995 | Sieger | |
| 6,006,569 | A * | 12/1999 | Shrayer et al. | 72/69 |
| 6,532,786 | B1 | 3/2003 | Luttgeharm | |
| 7,131,304 | B2 * | 11/2006 | Arai | 72/82 |

FOREIGN PATENT DOCUMENTS

| | | |
|---|---|---|
| DE | 1527973 | 9/1969 |
| EP | 0457358 | 5/1991 |
| EP | 0 593 799 B | 1/1996 |
| GB | 919 927 A | 2/1963 |
| GB | 2302832 | 2/1997 |

OTHER PUBLICATIONS

"International Search Report for corresponding PCT Application No. PCT/EP2004/003807" (Jul. 12, 2004), 3 pgs.
"Search Report of the Austrian Patent Office, date mailed May 28, 2003", 4 pgs.

* cited by examiner

*Primary Examiner*—Ed Tolan
(74) *Attorney, Agent, or Firm*—Schwegman, Lundberg, Woessner and Kluth

(57) ABSTRACT

The present invention relates, among other things, to a method for forming a workpiece ($\mathbf{24}_0$) of a material having an exponential tensile stress-strain behavior into a thin-walled, hollow shell ($\mathbf{24}_3$). In this method, the workpiece ($\mathbf{24}_0$) is clamped on its periphery and is actively rotated about its center line (M). A freely rotatable spinning die (4) having an external side (4*a*) with the desired shell shape ($\mathbf{24}_3$) is pressed with a suitable pressure force against a workpiece side (24*a*). At least one path-controlled spinning roller (14, 17) is pressed against the other workpiece side (24*b*) so that the rotating workpiece ($\mathbf{24}_0$) is formed into shell (24$_3$) exclusively by the local pressure forces, the relative velocity between the workpiece (24$_0$) and the at least one spinning roller (14, 17) and the force exerted on the workpiece (24$_0$) by the at least one spinning roller (14, 17) and the spinning die (4) being matched to one another such that the pressure forces applied to the workpiece (24$_0$) are below the yield strength of the workpiece (24$_0$). In addition, the present invention relates to a device for carrying out the method. Moreover, the present invention relates to a method and a device for forming a workpiece of a material which was previously only formable at known hot-forming temperatures, but as a result of the present invention, is now able to be formed into a thin-walled, hollow shell at a temperature below the hot-forming temperature known for the material of the workpiece.

31 Claims, 8 Drawing Sheets

METHOD AND DEVICE FOR DEFORMING A WORKPIECE MADE OF A MATERIAL HAVING AN EXPONENTIAL TENSILE STRESS-STRAIN BEHAVIOR INTO A THIN-WALLED, HOLLOW SHELL

CROSS-REFERENCE TO RELATED APPLICATION

This application is a national stage application of PCT/EP2004/003807, filed Apr. 8, 2004. which published as WO 2004/089560, and which claimed priority under 35 U.S.C. 119 to German Patent Application No. 103 16 854.0, filed Apr. 11, 2003, which application and publication are incorporated herein by reference and made a part hereof.

TECHNICAL AREA

The present invention relates to a method and a device for forming a workpiece of a material having an exponential tensile stress-strain behaviour into a thin-walled, hollow shell. Moreover, the present invention relates to a method and device for forming a workpiece of a material which was previously only formable at known hot-forming temperatures but as a result of the present invention, is now able to be formed at only slightly increased temperatures into a thin-walled, hollow shell.

BACKGROUND OF THE INVENTION

Workpieces of the aforementioned type exist for example in the form of round sheet metal blanks or sheet metal blanks which are only able to be formed into the desired shell shape in a complicated and thus expensive manner due to the indicated material properties. As a result of their low weight and good corrosion resistance, titanium and its alloys in particular are consequently used for fuel tanks and the like in the aviation and aerospace industries. However, the titanium-β alloys which are particularly suitable for this purpose are difficult to use in a cold-forming process. These alloys namely have an exponential tensile stress-strain behaviour. It is fundamentally only possible to form such materials into thin shells, in particular into a hemispherical shell, or into a hemisphere-like shell shape via pressure forming since the high-strength, light materials and their corresponding properties would otherwise be damaged. Such methods are also referred to as net-shape methods.

In general, EP 0 457 358 A2 describes a method and a device for metal spinning. It proposes clamping a blank of difficult to form material at the periphery and using a motion-controlled spinning tool 3 to curve it freely, i.e., without the use of a spinning chuck, into a free space to the final dimensions. A similar method and device are known from U.S. Pat. No. 3,342,051 in which forming without the use of a spinning chuck is also described. DE-OS 1 527 973 also teaches a similar method for producing surfaces of revolution without the use of a spinning die.

GB 2 302 832 A describes a method and device for metal shaping. In this known method, a blank is held by a centrally situated counterpunch on a rotating spinning die. The blank is formed via a spinning roller which follows a certain contour and forms the blank according to the shape. Such a method is not usable for forming materials of the type recited at the outset having a particularly high material tensile strength.

EP 0 593 799 B1 describes the forming of workpieces from the indicated materials. In particular, the specific forming problems are discussed in detail. In addition, the problems of other forming methods in the case of workpieces of the indicated materials are elucidated in detail. EP 0 593 799 B1 and parallel U.S. Pat. No. 5,426,964 teach a simpler and more cost-effective method for cold forming a material having an exponential tensile stress-strain behaviour into hollow shells having a low wall thickness. As a result, a sheet metal blank is clamped on the periphery and is rotated about its centre line via a drive. The rotating sheet metal blank is formed between a first and a second path-controlled spinning roller acting on opposite sides of the sheet metal blank and is cold-formed into a shell solely by local pressure forces. The relative velocity between the workpiece and spinning rollers and the force exerted by the spinning rollers on the workpiece are matched to one another such that tension forces applied to the workpiece are less than the yield strength of the material. According to this proposed method, the material is namely not exposed to any tension forces in the plastic area and the material is formed exclusively by pressure forces exerted on the workpiece by the two opposing spinning rollers.

This proposed method renders it possible to use cold forming to produce hollow shells having a large diameter and a relatively thin wall thickness to the final dimension without fatigue cracks or bulges being able to be detected and without occurrence of the problems resulting from heating of the material. A reason for this is that the achievable high cold-forming degree effects a grain refinement in the structure of the titanium-β alloy which then results in high strength and toughness so that the supporting cross section and thus the weight are able to be further reduced. In addition, the high cold forming degree in the peripheral direction results in a change in the texture of the original rolling direction of the cold-rolled sheet metal blank so that the risk of distortion due to residual stress associated with this texture is reduced. The pressure forces to be exerted via the spinning rollers are able to be regulated very precisely so that shells having a constant wall thickness as well as having a wall thickness varying over the periphery of the shell may be readily produced. As a result of the use of spinning rollers opposite one another, the occurring springback may be controlled so precisely that shells having very high dimensional accuracy are able to be produced. However, many "forming passes" may be necessary to achieve the desired shell shape, thereby making the method time-intensive and consequently also entailing relatively high manufacturing costs. It should be noted here that in this case the term "forming pass or forming steps" refers to the moving or passing through of a spinning roller from its starting position (in the area of the centre line of the workpiece to be formed) to its end position (near the periphery edge of the workpiece).

Finally for the sake of completeness, U.S. Pat. No. 3,248,918 is mentioned here. It describes a method for forming reflectors. In this method spherically formed metal reflectors are to be produced without a die which is referred to as expensive. In this case a flat circular blank of a metallic, radiation reflective material is clamped by a clamping means. The clamped sheet metal blank is rotated in order to bend the outer edge over. The thus pre-formed sheet metal blank is then secured again via other clamping means, is rotated again, and is then formed into the desired shaped. Forming special materials of the type recited at the outset having an exponential tensile stress-strain behaviour is obviously not possible using this method.

DESCRIPTION OF THE INVENTION

A technical objective of the present invention is for example the provision of a method for forming workpieces of a material having an exponential tensile stress-strain behaviour to create a thin-walled, hollow shell in minimal forming steps. A device allowing the forming of such workpieces in one or a few forming steps is also to be provided.

The technical objective of the present invention is achieved according to a first aspect of the present invention, for example, by a method for forming a workpiece of a material having an exponential tensile stress-strain behaviour into a thin-walled, hollow shell, in which, for example, at least the following steps may be performed. In the method, the workpiece is clamped on its peripheral side and is actively rotated about its centre line. A freely rotatable spinning die having an external side with the desired shell shape is pressed with a suitable pressure force against a workpiece side. At least one path-controlled spinning roller is pressed against the other workpiece side so that the workpiece rotating against the spinning die is formed at least partially or exclusively via local tension forces into a shell, the relative velocity between the workpiece and the at least one spinning roller and the force exerted on the workpiece by the at least one spinning roller and the spinning die being matched to one another such that the pressure forces exerted on the workpiece are less than the yield strength of the workpiece.

In addition, a device for carrying out a method according to the present invention is provided. For example, such a device may include a clamping device rotatable about a centre line for clamping the periphery of the workpiece. A drive is present for rotating the clamping device about the centre line. Such a drive may be an electric motor. It is also conceivable to use other drive types, such as pneumatic or hydraulic motors. The indicated exemplary embodiment of a device according to the present invention includes a spinning die freely rotatable about the centre line, shiftable in the direction of the centre line, and designed to exert a predefined pressure force on the workpiece. In addition, the device includes at least one path-controlled spinning roller opposite the spinning die. A first control device is used for controlling the at least one spinning roller in a path-controlled manner. A second control device ensures that the relative velocity between the workpiece and the at least one spinning roller and the force exerted on the workpiece by the at least one spinning roller and the spinning die are matched to one another such that the tension forces exerted on the workpiece are less than the yield strength of the material of the workpiece.

According to the present invention, a workpiece from the indicated special materials which are problematic for the forming process are therefore able to be cold formed without requiring a large number of forming passes of the at least one spinning roller; at least fewer forming passes are necessary than previously. As a result, a desired shell shape is able to be achieved in one or a few forming passes for the indicated materials. This is possible in that a push-pull forming process is performed according to the present invention, a pressing die having a convex outer shape providing the counterpressure for the spinning roller acting on the outside and a pre-pressure force from the shiftable die, with the feed rate adapted to the progress of the forming process, causing a tensile stress in the workpiece. This tensile stress is achieved in the workpiece in that the workpiece is fixedly clamped at its peripheral edge and the die is additionally used as a "drawing die". As a result of the additional tensile prestress, the expansion direction which is determined by the local rolling out of the material via the spinning roller is mainly diverted in the meridian direction. The spinning roller rolling for example parallel to the peripheral direction makes it possible to cause a local increase in gauge pressure without tensile prestress. However, in contrast to the known method indicated at the outset, only one "pass" may be necessary to achieve the shell shape. As a result, a deep draw counter spinning method is used for the first time.

In an exemplary embodiment of the present invention, the co-rotating forming or spinning die prestresses the workpiece. The at least one counter spinning roller always presses, for example, at the tangent point against the other side of the workpiece so that the peripheral expansion needed for shaping is effected by the local rolling out of the workpiece.

In an exemplary embodiment of the present invention, a higher number of spinning rollers, also called counter spinning rollers, may result in the risk of bulging being reduced, the production speed being increased, and the necessary pressure force per roller being reduced.

In an exemplary embodiment of the present invention, the forming process may be automatically controlled via a hydraulic proportioning valve control or via a CNC control. Of course, a method according to the present invention is not only able to be used for shaping or producing satellite tank shells but also for producing other materials and parts which are difficult to form.

As already mentioned, it may be advantageous in an exemplary embodiment of the present invention to move the spinning die in the direction of the centre line of the workpiece when forming the workpiece in order to apply the necessary tensile stress to the workpiece for which purpose a spinning roller was previously provided. At the same time, the total size of such a device may be kept to a minimum in that the spinning rollers essentially retain their position viewed in the direction of the centre line.

As a result of the previously explained design, the spinning die rotates at the same velocity as the workpiece so that there is no relative movement between the workpiece and the top side of the spinning die which would result in problems in the case of the indicated material.

In the case of an exemplary embodiment of the present invention, titanium-β alloys as well as all materials previously specified in EP 0 593 799 B1 are able to be formed more simply using the method of the present invention. For example, titanium sheets of Ti 15-3-3-3 or Ti-β-21S are formable using the method according to the present invention. In addition, workpieces of Ti-15V-3Al-3Cr-3Sn are formable, for example. The shell dimensions indicated in EP 0 593 799 B1 may also be produced using the method according to the present invention. This means, for example, that shells having a diameter of up to 1000 mm or more and thicknesses of 0.5–2 and up to 6 mm or more may be produced using the method according to the present invention. In particular, the initial workpieces have a thickness of approx. 5 to 40 mm.

According to a further exemplary embodiment of a method according to the present invention, the angle of tilt of the at least one spinning roller is changed with respect to the peripheral direction, depending on the distance of the at least one spinning roller from the centre line of the workpiece and the shape of the spinning die at this location. In particular, the roller radius and the roller diameter are adjusted to the pressure forces needed for the forming process and to the forming direction. As a result, in the case of a large roller diameter and a small radius, increased forming takes place in the meridian direction than in the peripheral direction and vice versa.

In a further exemplary embodiment of a device according to the present invention, it is preferred to use at least two, three, or four spinning rollers situated evenly about a circle so that faster forming is achievable.

Another exemplary embodiment of a device according to the present invention provides for the clamping device to be made up of a first clamping ring and a second clamping ring which are able to be tensioned with respect to one another via clamping means, the periphery edge of the workpiece being able to be clamped between the two clamping rings.

A further exemplary embodiment of the device according to the present invention provides for one of the two clamping rings or one inner bearing ring to have external toothing with which a toothed wheel driven by a drive meshes.

Alternatively, it may also be expedient for the pivot bearing to which the clamping or tensioning rings are attached to have a toothed ring on the inner bearing ring with which a drive pinion meshes. In this context, it may be advantageous to tighten the clamping or tensioning rings to the inner bearing ring. The inner bearing ring is secured to the stator of the device and withstands the radial and axial peripheral forces.

In the case of larger bearing rotating rings and the consequently higher peripheral speeds which are needed for forming, meshing toothed wheels may cause significant background noise which may be disadvantageous. It may be advantageous in this case to design a drive such that a forming belt or a rubber-coated friction wheel is provided for rotating the pivot bearing of the clamping device.

In a further exemplary embodiment of a device according to the present invention, the at least one spinning roller is tiltable in a desired manner with respect to the peripheral direction at certain meridian points.

In another exemplary embodiment of the device according to the present invention, the at least one spinning roller is tiltable via a parallelogram guide in the desired manner with respect to the peripheral direction.

For example, the at least one spinning roller may also be guided by a three-axle control.

In a further exemplary embodiment of the device according to the present invention, the first control device and the second control device are combined to form one common control device.

In another exemplary embodiment of the device according to the present invention, at least one additional spinning roller having a larger diameter is available for exchange in order to form edge areas of the workpiece.

An additional exemplary embodiment of the device according to the present invention includes a machining tool, in particular a turning tool. Using the machining tool, the still clamped workpiece is able to be machined in the desired workpiece areas.

Finally, a further exemplary embodiment of a device according to the present invention may include a cut-off tool for separating a completed workpiece.

Another technical objective of the present invention is to provide a method for forming workpieces into thin-walled, hollow shells in which the workpieces do not need to be heated to a classic hot-forming temperature in order to form them but only to a lower temperature.

This technical objective is achieved by a method including for example at least the following steps: A workpiece blank is clamped on the periphery and is actively rotated about its centre line. The workpiece blank is heated at least in certain partial areas to a temperature below the hot-forming temperature known for the material of this blank. A freely rotatable spinning die having an external side with the desired shell shape is then pressed with a suitable pressure force against a workpiece side. At least one path-controlled spinning roller is pressed against the other workpiece side (in the above indicated heated partial areas) so that the workpiece blank rotating against the spinning die is formed into a shell exclusively by local pressure forces, the relative velocity between the workpiece and the at least one spinning roller and the pressure exerted on the workpiece by the at least one spinning roller and the spinning die are matched to one another such that pressure forces exerted on the workpiece are below the yield strength of the workpiece.

In an exemplary method according to the present invention, the workpiece blank is made of a titanium alloy, in particular of titanium alloy Ti6-4. The processing temperature may be selected, for example, such that the state of the exponential tensile stress-strain behaviour is achieved in the workpiece blank but no $\alpha$-case is formed.

In an alternative exemplary method according to the present invention, a workpiece blank of a high-strength Al alloy is formed into a shell. In particular the Al alloy is Al-2219.

When forming a workpiece of a high-strength Al alloy, the processing temperature is selected in particular so that an artificially aged state is achieved in the workpiece blank.

According to a further aspect of the present invention, an exemplary embodiment of a device for implementing the above-mentioned method includes a clamping device rotatable about a centre line for clamping the workpiece on its periphery. A drive is provided for rotating the clamping device about the centre line. A spinning die which is freely rotatable about the centre line, is shiftable in the direction of the centre line, and is designed for exerting a predefined pressure force on the workpiece is also provided. In addition, the device includes at least one path-controlled spinning roller opposite the spinning die. A first heating device is used at least for heating the workpiece area in which the at least one spinning roller contacts the workpiece. The path of the at least one spinning roller is controlled by a first control device. A second control device ensures that the relative velocity between the workpiece and the at least one spinning roller and the force exerted on the workpiece by the at least one spinning roller and the spinning dies are matched to one another such that the tension forces exerted on the workpiece are less than the yield strength of the material of the workpiece.

In a further exemplary embodiment of the present invention, the spinning die is heated to a certain holding temperature via second heating device.

In another exemplary embodiment of the present invention, the first heating device is made up of a plurality of heating devices which are able to heat the separate workpiece areas to the desired processing temperature.

In a further exemplary embodiment of the present invention, the position of the first heating device may be changed mechanically or manually.

In another exemplary embodiment of the present invention, the first heating device and the second heating device are gas burners.

In a further exemplary embodiment of the present invention, the heating devices are heating coils or infrared heating devices.

BRIEF DESCRIPTION OF THE DRAWINGS

A plurality of exemplary embodiments of the present invention are described and explained in greater detail in the following with reference to the included drawing in order to provide further explanation and to improve understanding. The figures show.

DESCRIPTION OF A PLURALITY OF EXEMPLARY EMBODIMENTS OF THE PRESENT INVENTION

Figure 1:
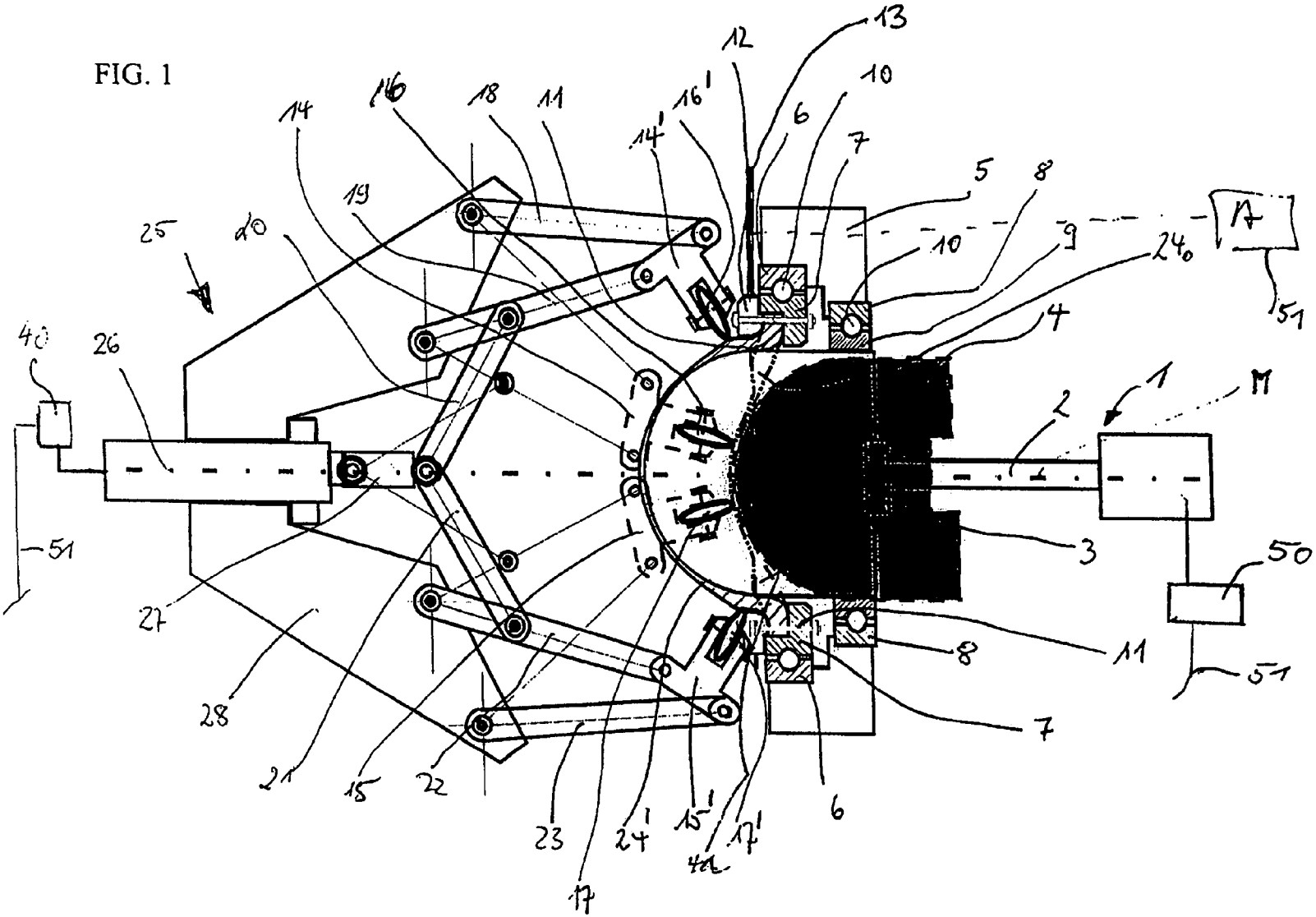
FIG. 1 shows a schematic side view of an exemplary embodiment of a device according to the present invention.

According to FIG. 1, a device according to the present invention includes for example a spinning device 1, including a spinning unit 4, a compression column 2, a control device 50. Spinning die 4 has an exterior side 4*a* corresponding to the desired shell shape. This external side 4*a* of spinning die 4 is designed to be fundamentally convex. However, as viewed from the cross section, the external side is able to have a constant curvature or also a changing curvature direction.

Spinning die 4 is coupled with compression column 2. This compression column 2 is part of a piston-cylinder unit which uses a pneumatic or hydraulic unit to shift spinning die 4 with a predefined force. This piston-cylinder unit and thus spinning and drawing die 4 are controlled in the direction of a centre line M via control device 50.

The device also includes a holder 5 in which a clamping device is embedded. In this case, the clamping device includes a first clamping ring 7 and second clamping ring 12 which may be tensioned with respect to one another via clamping screws distributed uniformly over the periphery. First clamping ring 7 is simultaneously the inner ring of a rolling bearing. Outer ring 6 is integrated in holder 5. Like a normal ball bearing, outer rolling bearing ring 6 and inner rolling bearing ring 7 are supported in rolling bearings via balls in this case. There is also a second rolling bearing of inner ring 9 and outer ring 8 as well as interposed balls for supporting the entire device in holder 5 in a rotatable manner.

Second clamping ring 12 is provided in this case with external toothing with which a schematically shown toothed wheel engages. This toothed wheel is driven by a drive A, which is also only schematically shown, so that clamping ring 12 is able to be driven via toothed wheel 13 in a controlled manner. Alternatively, it may be expedient to provide inner rolling bearing ring 7 with toothing with which a toothed wheel (not shown here) also driven by a drive meshes. A further alternative for rotating clamped workpiece $\mathbf{24}_0$ could entail the inner bearing ring or a component connected thereto (not shown) being driven by a forming belt coupled with a drive wheel. Configuration as a rubber-coated friction wheel is also possible. In this case, a small friction wheel including the meshing gear wheel fixedly connected to inner bearing ring 7 would be driven in a rotating manner via friction contact.

It should also be mentioned that spinning die 4 is rotatably supported on compression column 2 but is not driven. It is also possible for spinning die 4 and compression column 2 not to be rotatably connected to one another but for compression column 2 to be rotatable in the piston-cylinder unit.

A spinning roller bearing 24 is situated in holder 5. Spinning roller bearing 25 includes a basic body 28 on which different rods or bars 18, 19, 20, 21, 22, 23 are rotatably supported. Two of rods 18, 19 and 22, 23 rotatably supported on basic body 28 have spinning roller holders 14, 15 at their free ends. These are then rotatably supported on the particular rods. Spinning rollers 16, 17 are rotatably supported at holders 14, 15. As a result of the formed parallelogram, the tilt of the spinning rollers is able to be changed and the spinning rollers may be shifted toward the outside, i.e., the distance to centre line M is changeable. As a result of the parallelogram kinematics, spinning rollers 16, 17 essentially always remain at the same level even at an increased distance from centre line M. At the same time, spinning rollers 16, 17 have the necessary and most expedient tilt for the forming process at every peripheral line of workpiece 24.

Both holders 14, 15 are coupled with one another via rods 20, 21. These two rods are then coupled via a shared spinning rod 27 with a piston-cylinder unit 26. Piston-cylinder unit 26 causes the spinning rollers to separate and consequently results in an adjustable distance from centre line M. Piston-cylinder unit 26 is controllable via a control device 40. Control device 40 as well as control device 50 for piston-cylinder unit 1 of spinning die 4 as well as drive A may be connected to one another via cable 51 or integrated into one common control device.

The previously indicated embodiment of a device of the present invention functions and is operated as follows. Workpiece $\mathbf{24}_0$ is a sheet metal blank and preferably is in the shape of a circular disk as viewed from above. This sheet metal blank is clamped at its periphery between the two clamping rings 7 and 12. The drive of clamping ring 12 is then operated to consequently actively rotate workpiece $\mathbf{24}_0$ about centre line M. Spinning rollers 16, 17 are then moved close to the centre point, i.e., on the level of centre line M, against one side of workpiece $\mathbf{24}_0$ and at the same time spinning die 4 is pressed with a predefined force against the other side of workpiece $\mathbf{24}_0$ so that workpiece $\mathbf{24}_0$ is increasingly curved and is simultaneously rotated, while a counterforce is applied by spinning rollers 16, 17.

Figure 8:
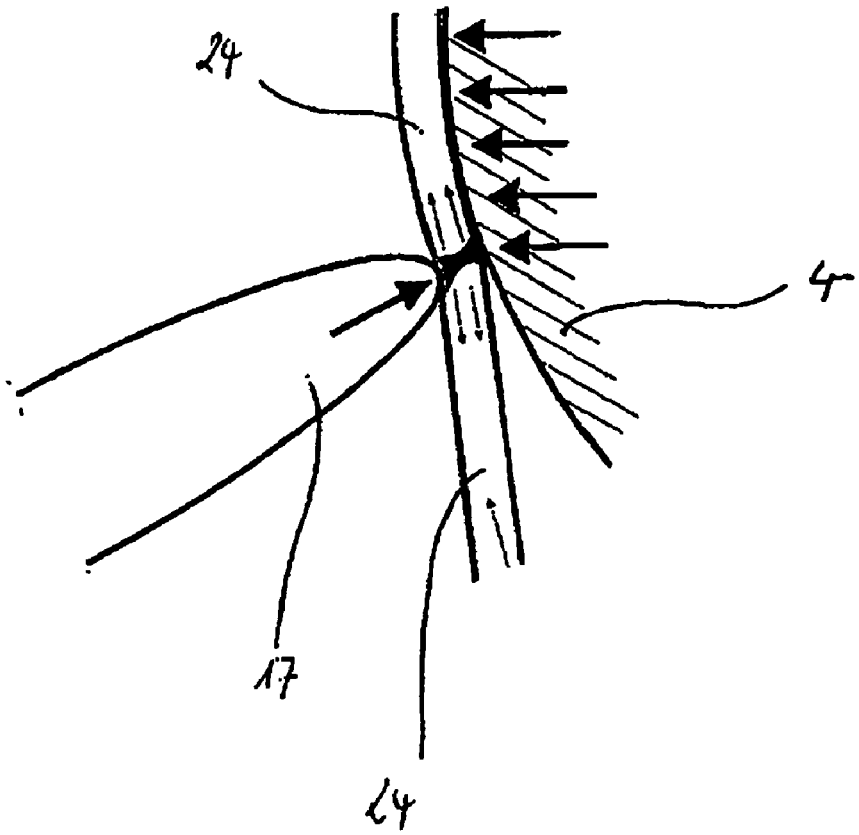
FIG. 8 shows a schematic representation of the processes in the workpiece during forming.

The spinning die may also preferably be moved against workpiece $\mathbf{24}_0$ before it is rotated. These processes are controlled by controls 40, 50, 51. Spinning die 4 is moved continuously further in the centre line direction, and at the same time spinning rollers 16, 17 are slowly displaced toward the outside via the parallelogram rods. In this context, spinning rollers 16, 17 follow the contour of spinning die 4, i.e., the desired shell shape. During this process, workpiece 24 is formed at the tangent points, i.e., the locations at which workpiece 24 lifts from the external side of die 4. In this context, it is important that the pressure forces of spinning die 4 as well as the rotational velocity of workpiece 24 and the counterforce of spinning rollers 16, 17 are matched to one another such that workpiece 24 according to the representation in FIG. 8 is formed as desired without bulges or the like. At the same time, it is ensured in this case via the parallelogram rods that spinning rollers 16, 17 have the correct tilt with respect to centre line M which is also dependent on the shape of spinning die 4.

Therefore, if possible, workpiece $\mathbf{24}_0$ may be formed in only one pass of spinning rollers 16, 17 from the inside, i.e., centre line M, to the outside. However, it is also possible for spinning rollers 16, 17 to be moved back to the centre and another forming process and a further application of force via spinning die 4 to be performed so that a plurality of "passes" are necessary to achieve complete forming according to the predefined outer contour of spinning die 4. However, this number is significantly less than that of the known method indicated at the outset.

Again in this case, spinning rollers 16, 17 are in the position near centre line M at the start of the forming process. Their final position at the end of the forming process is indicated by an apostrophe. The final shape of workpiece 24 is indicated here by reference numeral 24'.

Figure 2:
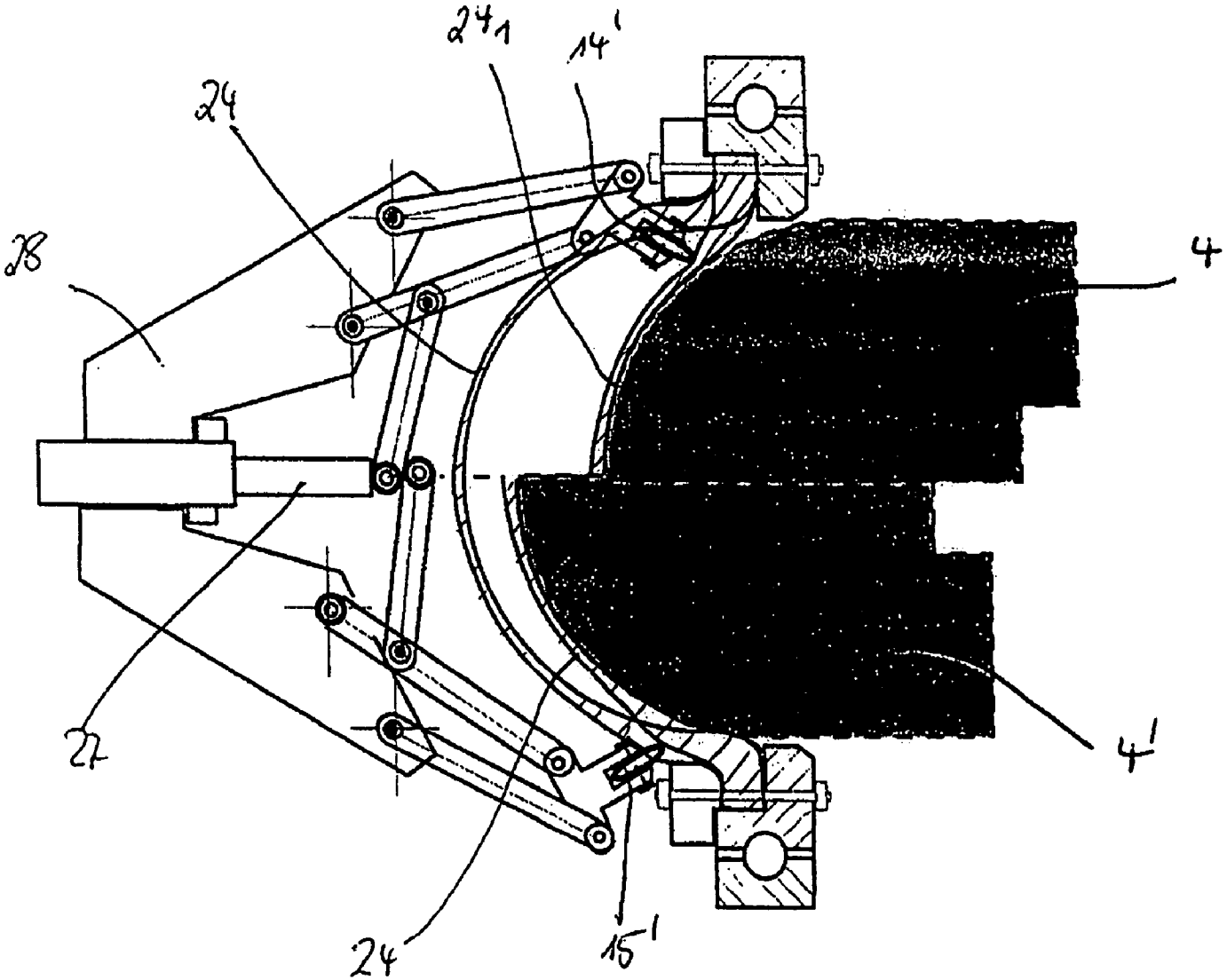
FIG. 2 shows a representation similar to that in FIG. 1 and indicating two different positions of a spinning die.

The representation according to FIG. 2 shows the different displacement degrees of compression column [sic spinning die] 4. In addition, the different forming degrees of workpiece 24 are also shown. The final position is indicated here by $\mathbf{24}_3$, and an intermediate position is indicated by $\mathbf{24}_1$ and $\mathbf{24}_2$.

Figure 3:
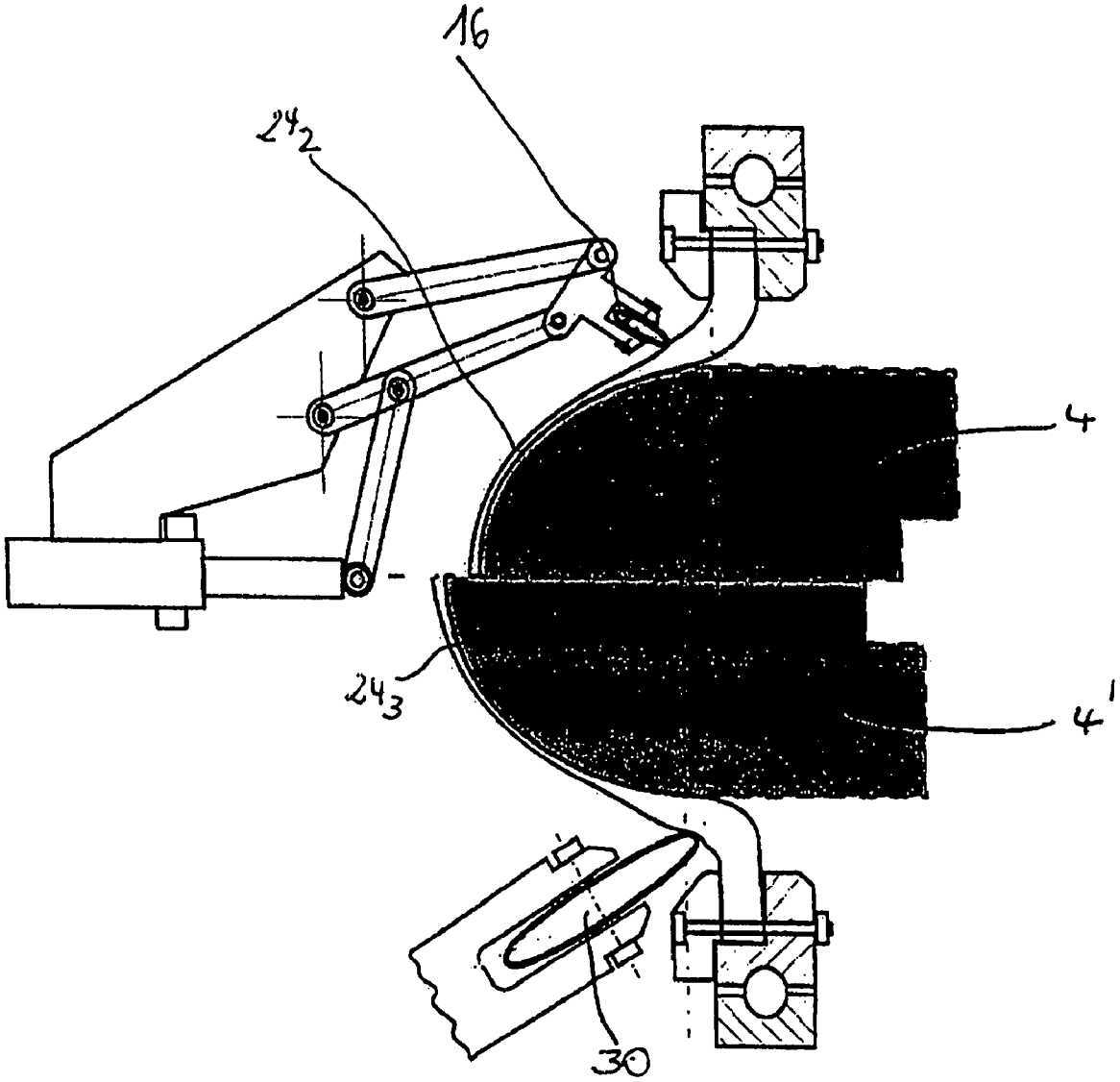
FIG. 3 shows a representation very similar to that in FIG. 2 of a further embodiment of a device according to the present invention having an additional spinning roller with a greater diameter for forming a workpiece section further on the periphery of the workpiece.

FIG. 3 shows another exemplary embodiment of a device according to the present invention. In this case, one or more spinning rollers 30 having a greater diameter is/are used for shaping the edge of workpiece $\mathbf{24}_3$. In this case, greater diameter means a diameter which is greater than that of spinning rollers 16, 17 which are provided for initial forming.

Figure 4:
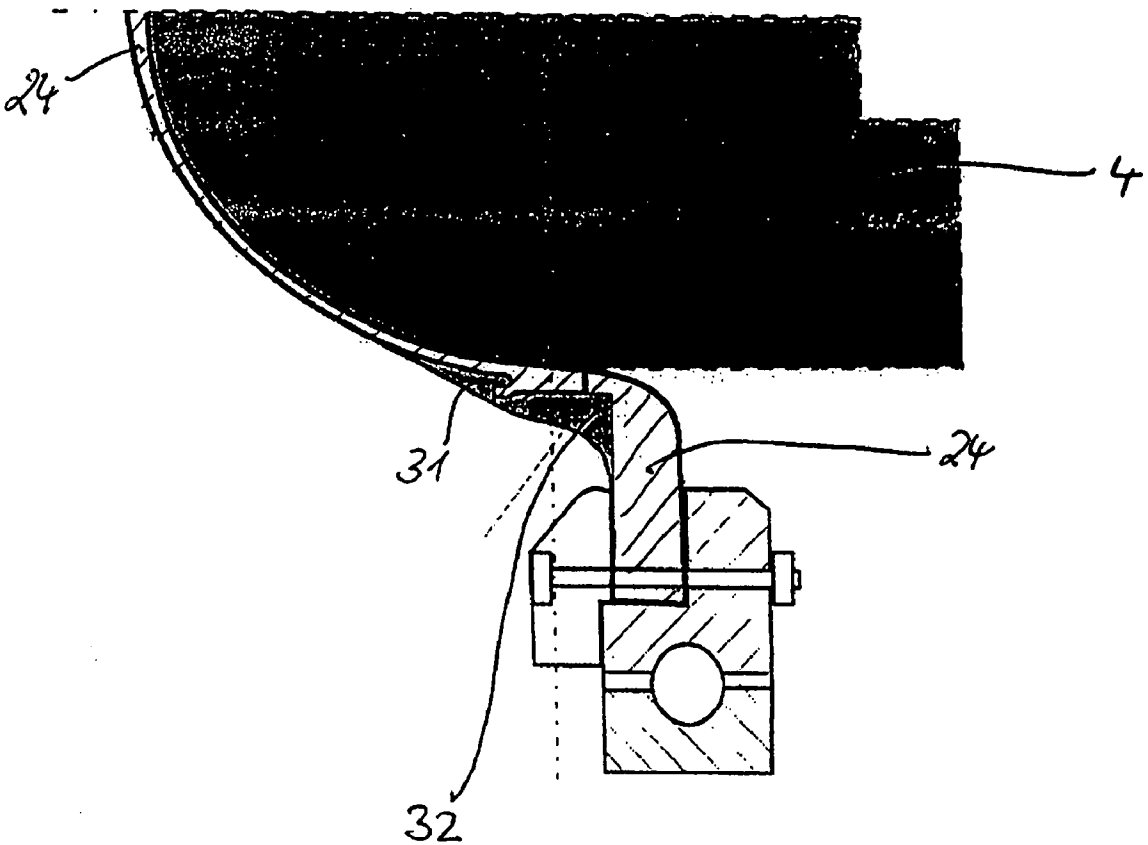
FIG. 4 shows a partial sectional view of a workpiece formed according to the present invention and having sections to be machined.
Figure 5:
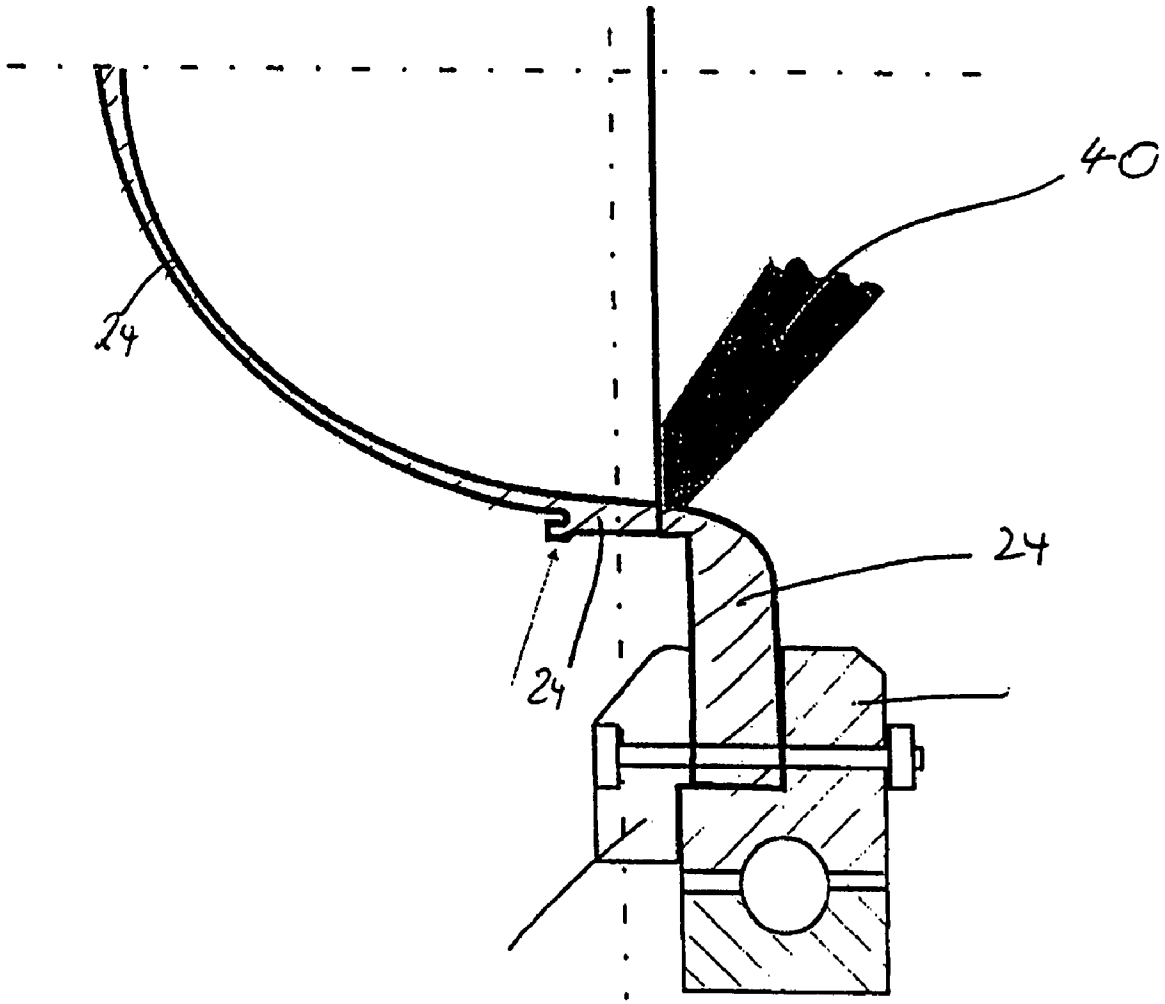
FIG. 5 shows a representation similar to that in FIG. 4 and including representation of a cut-off tool.

According to FIG. 4, shell 24 in the final state has areas 31, 32 which are still to be twisted off. Therefore, for example, edge areas of shell 24 are able to be machined while workpiece 24 is clamped. The shell which is finished on the outside is also able to be separated via a cut-off tool 40 as shown in FIG. 5.

Figure 6:
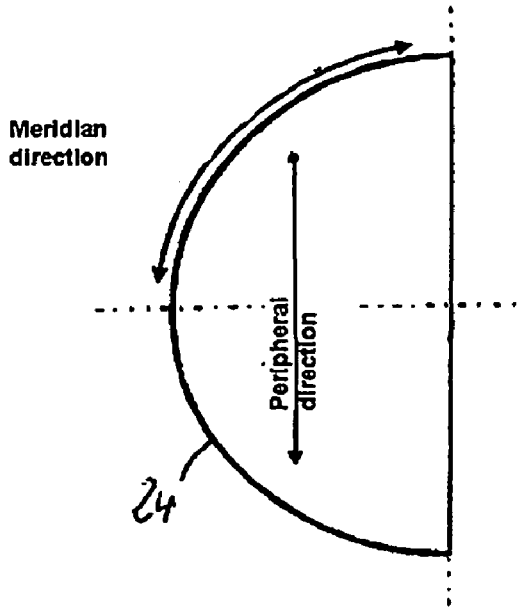
FIG. 6 shows a schematic representation for illustrating different directions.
Figure 7:
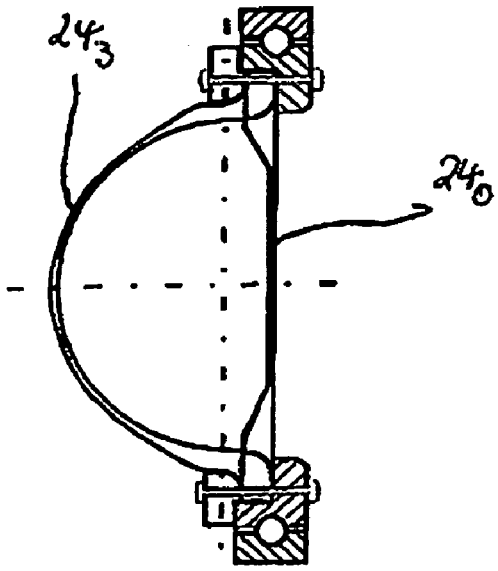
FIG. 7 shows a further schematic representation of a workpiece in the initial and end shape.

To provide an improved overview, FIG. 6 again shows the different directions. The peripheral direction runs vertical to centre line M, the meridian direction runs along the outer contour of spinning die 4 or finished shell 24 in this case. To provide an improved overview, FIG. 7 again shows a workpiece $\mathbf{24}_0$ in its initial form and reference numeral $\mathbf{24}_3$ indicates the workpiece in its final form.

As already explained, FIG. 8 shows the fundamental pressure forces applied to workpiece 24 at certain points by spinning rollers 16, 17 and spinning die 4 and resulting in the desired forming without exceeding the yield strength of the material of workpiece 24.

Figure 9:
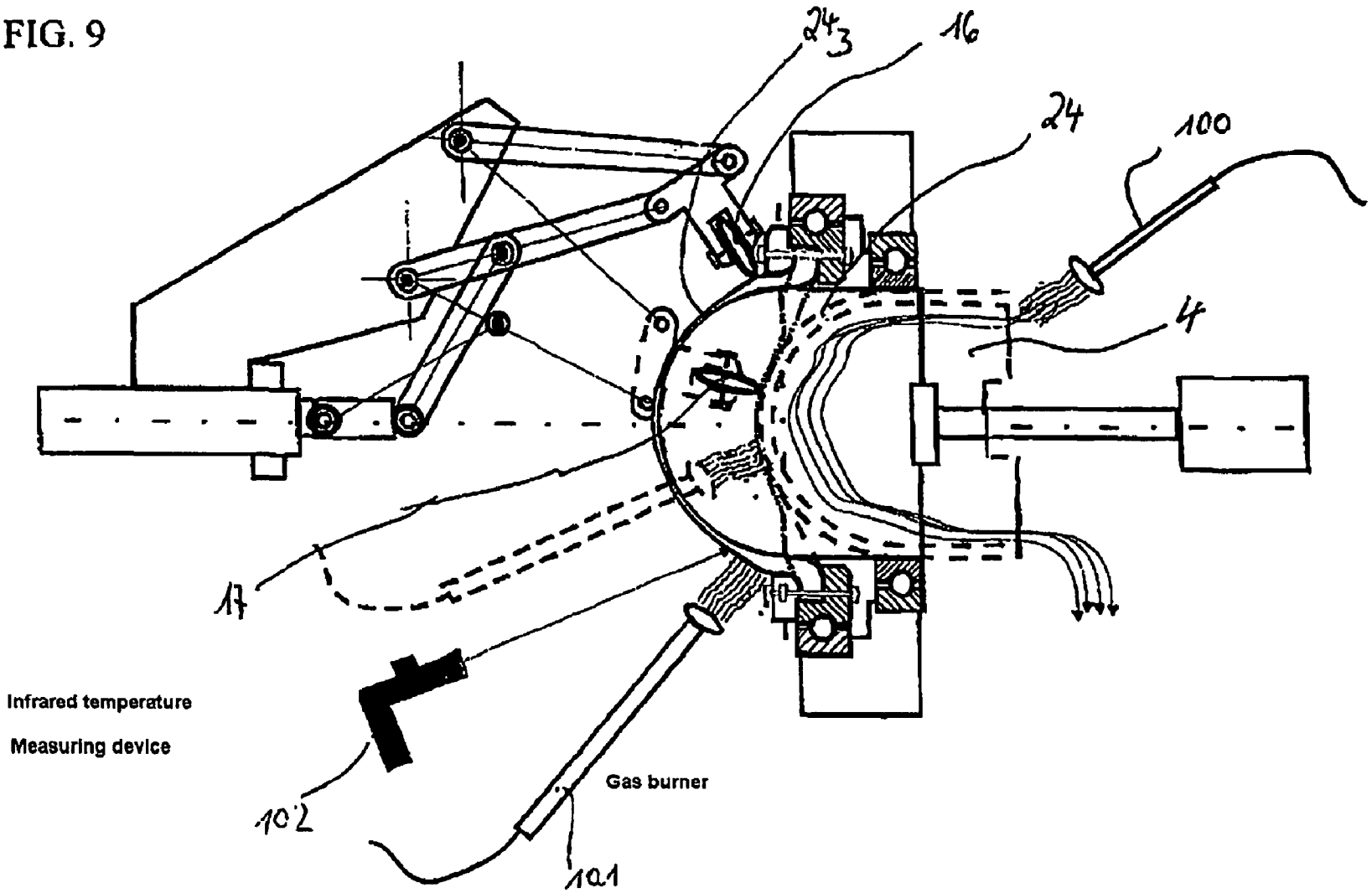
FIG. 9 shows a schematic sectional view of a further embodiment of a device according to the present invention for forming a workpiece of a material previously only formable at known hot forming temperatures.
Figure 10:
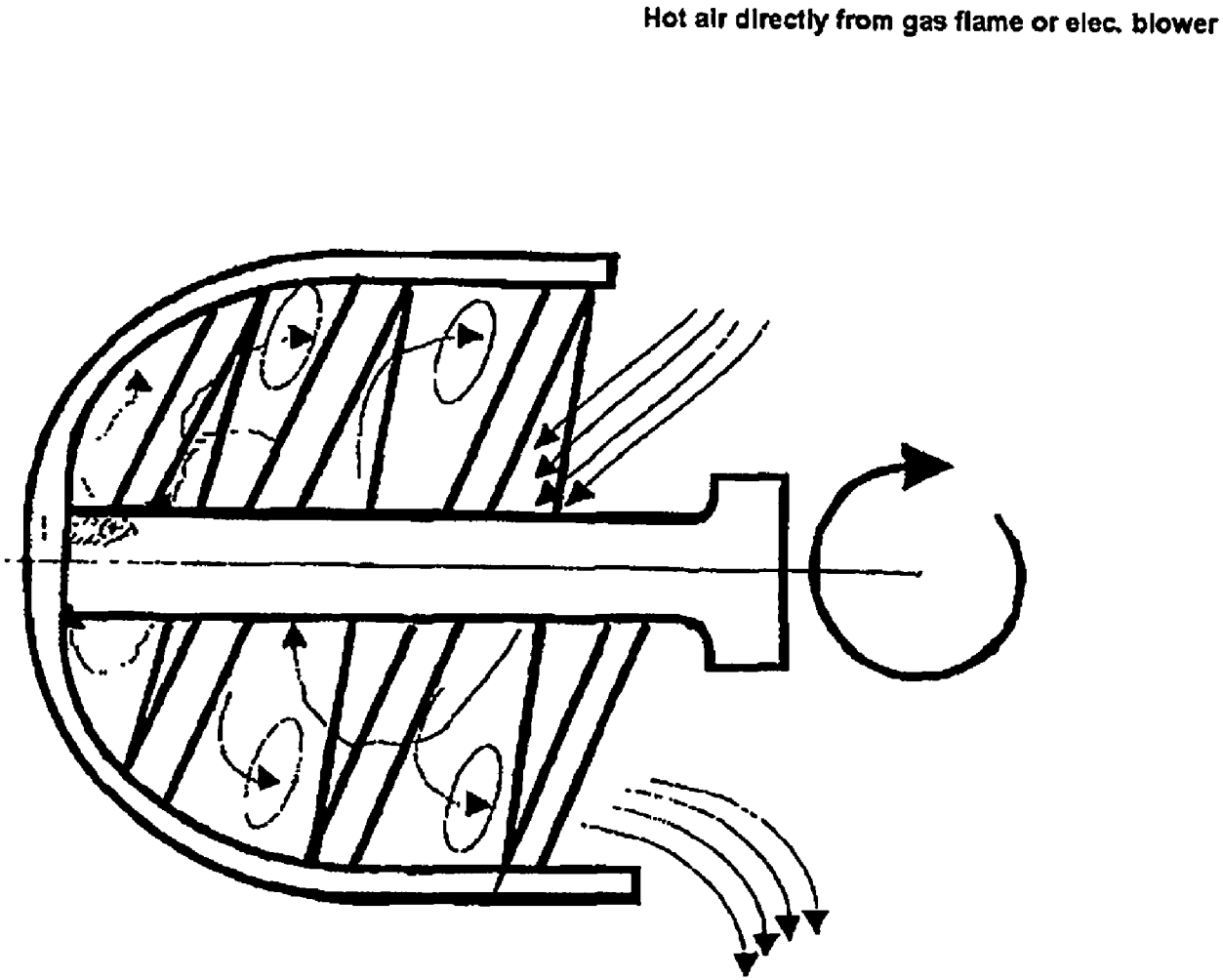
FIG. 10 shows a schematically represented modification of the device of the present invention shown in FIG. 9.

The exemplary embodiment shown in FIG. 9 of a device of the present invention has the same essential features of the device explained in detail above on the basis of FIG. 1 through 8. The exemplary embodiment shown here includes the previously explained technical features of the device according to the present invention as well as a first heating device 100 and a second heating device 101. Both heating devices are designed as gas burners in this case. First heating device 100 is designed such that a warm air stream flows along the inside of workpiece 24. For example, it is also possible for this first heating device 100 to include a plurality of heating locations so that the inside of workpiece 24 is heated in different partial areas. Second heating device 101 is aligned such that it heats the outside of workpiece 24. However, in an exemplary embodiment of a device according to the present invention, a single heating device may also be sufficient. In particular, it must also be mentioned that in the embodiment shown here, the outside of spinning die 4 has different channels so that the warm air stream of first heating device 100 is able to flow through. In some cases, it is also expedient for small holes to be provided in spinning die 4 so that the warm air also comes in direct contact with workpiece 24. Indirect heating may also be advantageous.

In particular, it may be advantageous for second heating device 101 to be designed to be shiftable or movable so that heating always occurs on the outside of workpiece 24 in the area of the spinning rollers. In addition, a plurality of second heating devices may be provided instead of a single second heating device 101 so that workpiece 24 is also heated on the outside in the area of all spinning rollers 16, 17. In particular, it may also be expedient to provide a temperature measuring device 102 which measures the surface temperature of workpiece 24 and brings it to the appropriate hot-forming temperature which according to the present invention is lower in this forming method than previous hot-forming temperatures. As a result, a corresponding hot-forming temperature of the present invention may be in a range, for example, between 500° C. and 600° C., while classic hot-forming temperatures are over 600° C., for example. In particular, conventional forming methods necessitate temperatures between 650° C. and 850° C.

In an embodiment of a device according to FIG. 9, workpiece 24, i.e., the workpiece blank, in particular a sheet metal blank, is heated to a hot-forming temperature of less than 650° C. and formed via spinning rollers 16, 17, as already described on the basis of FIG. 1 through 8. Compression column [sic spinning die] 4 etc is accordingly moved against the spinning rollers and workpiece 24 is formed into a shell. At the same time, workpiece 24 is kept at the necessary forming temperature via temperature measuring device 102 and heating devices 100, 101. In this exemplary embodiment, workpiece 24 is made of a titanium alloy Ti 6-4 (Ti 6Al4V). As a result of the selected forming temperature of approximately 600° C., there is no oxidation even in the case of a longer processing time, i.e., there is no oxide layer or alpha case layer. In the case of conventional forming methods requiring a forming temperature of 650° C. to 850° C., oxide and diffusion layers (the aforementioned alpha case layers) start forming already after 0.1 hours. As a result of the combined method according to the present invention and the achievement of a hot-forming temperature previously not suitable for the forming process, the previously disadvantageous oxide layer or $\alpha$-case layer formation is able to be prevented.

Accordingly, the previously necessary mechanical post-processing of a surface of a created shell.

As already mentioned, high-strength aluminium alloys for which the forming temperatures are able to be kept very low present an alternative material. From a metallurgical standpoint, workpiece 24 is then able to be formed into a shell $\mathbf{24}_3$ without creating structural changes in workpiece 24. Such a method according to the present invention allows for the first time high forming degrees in different hardening states. In this context, the advantage is achieved that finished workpiece $24_3$ does not need to be solution annealed and then drawn out and cold cured or hot cured. Therefore, in particular the spinning die or drawing die must be brought to and held at a basic temperature of approximately 100° C. less than the desired forming temperature of the workpiece in the representation according to FIG. 9. In this context sufficient pressure resistance of the device and the thermal expansion with respect to the geometrical accuracy must be taken into consideration. The reason for the heating of spinning die 4 is the prevention of heat dissipation from the workpiece. The actually desired forming temperature is achieved from the outside directly on workpiece 24 via second heating device 101, in particular only at the location at which the forming process is performed (in particular tangential).

Second heating device 101 may be moved in a controlled manner, in particular manually or mechanically, according to the spinning roller movement. The temperature may be monitored depending on the series size either manually or via a control loop control.

The pressure device including its rolling bearings and hydraulic cylinders is advantageously protected from overheating according to the known standard by heat shields and corresponding cooling devices, as needed.

The invention claimed is:

1. A method for forming a workpiece of a material having an exponential tensile stress-strain behaviour into a thin-walled, hollow shell, comprising:

clamping the workpiece on its periphery and actively rotating it about its center line;

pressing a freely rotatable spinning die having an external side with the desired shell shape with a suitable pressure force against a workpiece side; and pressing at least one path-controlled spinning roller against the other workpiece side so that the rotating workpiece is formed into a shell exclusively via local pressure forces, the relative velocity between the workpiece and the at least one spinning roller and the force exerted on the workpiece by the at least one spinning roller and the spinning die being matched to one another such that tensile forces applied to the workpiece are below the yield strength of the material of the workpiece.

2. The method as recited in claim 1, wherein the spinning die is moved in the direction of the centre line of the workpiece during forming of the workpiece.

3. The method as recited in claim 1, wherein the spinning die is rotated at the same rotational velocity as the workpiece during the forming process.

4. The method as recited in claim 1, wherein the workpiece is made of one titanium and titanium-β alloy.

5. The method as recited in claim 1, wherein the angle of tilt of the at least one spinning roller is changed with respect to the peripheral direction.

6. The method as recited in claim 1, wherein the position of the at least one spinning roller in the direction of the center line remains essentially the same during the forming process.

7. A device for forming a workpiece of a material having an exponential tensile stress-strain behaviour into a thin-walled, hollow shell, comprising:

a clamping device rotatable about center line for clamping the periphery of the workpiece;

a drive for rotating the clamping device about the center line;

a spinning die which is freely rotatable about the center line, is movable in the direction of the center line, and is designed to exert a predefined pressure force against the workpiece;

at least one path-controlled spinning roller opposite the spinning die;

a first control device for controlling the at least one spinning roller in a path-controlled manner; and a second control device which ensures that the relative velocity between the workpiece and the at least one spinning roller and the force exerted on the workpiece by the at least one spinning roller and the spinning die are matched to one another such that the tension forces applied to the workpiece are less than the yield strength of the material of the workpiece.

8. The device as recited in claim 7, wherein the clamping device is made of a first clamping ring and a second clamping ring which may be tensioned with respect to one another via clamping means, the peripheral edge of the workpiece being clampable between the two clamping rings.

9. The device as recited in claim 8, wherein one of the two clamping rings has external toothing with which a toothed wheel driven by a drive meshes.

10. The device as recited in claim 7, wherein at least one spinning roller is tiltable in the desired manner with respect to the peripheral direction at a specific meridian location.

11. The device as recited in claim 10, wherein the at least one spinning roller is tiltable via a parallelogram guide in the desired manner with respect to the peripheral direction at a specific meridian location.

12. The device as recited in claim 7, wherein the at least one spinning roller is guided via a three-axle control.

13. The device as recited in claim 7, wherein the first control device and the second control device are integrated into one common control device.

14. The device as recited in claim 7, wherein at least one additional spinning roller having a greater diameter is available for exchange in order to form the edge areas of the workpiece.

15. The device as recited in claim 7, wherein one of a machining tool a turning tool is used to machine the still clamped workpiece in the desired workpiece areas.

16. The device as recited in claim 7, wherein a cut-off tool is available for separating a finished workpiece.

17. A method for forming a workpiece blank of a material into a thin-walled, hollow shell comprising:

clamping the workpiece blank on its periphery and actively rotating it about its center line;

pressing a freely rotatable spinning die having an external side with the desired shell shape with a suitable pressure force against a workpiece side;

pressing at least one path-controlled spinning roller against the other workpiece side so that the rotating workpiece is formed into shell exclusively by local pressure forces, the relative velocity between the workpiece and the at least one spinning roller and the force exerted on the workpiece by the at least one spinning roller and the spinning die being matched to one another such that tension forces applied to the workpiece are less than the yield strength of the material of the workpiece;

heating the workpiece blank to a processing temperature below the known hot-forming temperature for this material at least in the partial areas contacted by the spinning rollers.

18. The method as recited in claim 17, wherein the material of the workpiece blank is Ti 6-4.

19. The method as recited in claim 17, wherein the processing temperature is selected such that the state of the exponential tensile stress-strain behaviour is achieved in the workpiece blank but no alpha case is formed.

20. The method as recited in claim 17, wherein the material of the workpiece blank is a high-strength Al alloy and Al-2219.

21. The method as recited in claim 20, wherein the processing temperature is selected such that a naturally aged state is achieved in the workpiece blank.

22. The method as recited in claim 17, wherein the spinning die is heated to a temperature below the hot-forming temperature of the workpiece.

23. The method as recited in claim 22, wherein the temperature of the external side of the spinning die is between 50° C. and 150° C., in particular 100° C.

24. The method as recited in claim 17, wherein the workpiece blank is only heated to the processing temperature in the area of the spinning rollers.

25. The method as recited in claim 19, wherein the processing temperature is between 500° C. and 650° C.

26. A device for forming a workpiece of a material having an exponential tensile stress-strain behaviour into a thin-walled, hollow shell, comprising:

a clamping device rotatable about a center line for clamping the periphery of the workpiece;

a drive for rotating the clamping device about the center line;

a spinning die which is freely rotatable about the center line, is movable in the direction of the center line, and is designed for exerting a predefined pressure force on the workpiece;

at least one path-controlled spinning roller opposite the spinning die;

a first heating device designed for heating at least the workpiece area in which the at least one spinning roller contacts the workpiece;

a first control device for controlling the at least one spinning roller in a path-controlled manner; and a second control device which ensures that the relative velocity between the workpiece and the at least one spinning roller and the force exerted on the workpiece by the at least one spinning roller and the spinning die are matched to one another such that the tension forces applied to the workpiece are less than the yield strength of the material of the workpiece.

27. The device as recited in claim 26, wherein the spinning die is heated to a specific holding temperature via a second heating device.

28. The device as recited in claim 26, wherein the first heating device is made of a plurality of heating devices which are able to heat separate workpiece areas to the desired processing temperature.

29. The device as recited in claim 27, wherein the position of the heating device may be changed mechanically or manually.

30. The device as recited in claim 26, wherein the first heating device and the second heating device are gas burners.

31. The device as recited in claim 26, wherein the heating devices are heating coils or infrared heating devices.

* * * * *